US008107857B2

(12) United States Patent
Kobayashi

(10) Patent No.: US 8,107,857 B2
(45) Date of Patent: Jan. 31, 2012

(54) FIXING DEVICE AND IMAGE FORMING APPARATUS

(75) Inventor: Kei Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 497 days.

(21) Appl. No.: 12/292,163

(22) Filed: Nov. 13, 2008

(65) Prior Publication Data

US 2009/0136274 A1 May 28, 2009

(30) Foreign Application Priority Data

Nov. 28, 2007 (JP) ..... 2007-307324

(51) Int. Cl.
*G03G 15/16* (2006.01)

(52) U.S. Cl. ..... 399/122; 399/329

(58) Field of Classification Search ..... 399/30, 399/122, 329
See application file for complete search history.

(56) References Cited

U.S. PATENT DOCUMENTS

| | | | | |
|---|---|---|---|---|
| 5,386,281 | A * | 1/1995 | Mitani et al. | 399/329 |
| 2002/0018676 | A1 * | 2/2002 | Hirai et al. | 399/329 |

FOREIGN PATENT DOCUMENTS

| | | |
|---|---|---|
| JP | 06-067556 | 3/1994 |
| JP | 2002-333788 | 11/2002 |
| JP | 2005-077880 A | 3/2005 |
| JP | 2006-072182 | 3/2006 |
| JP | 2006-251108 A | 9/2006 |
| JP | 2007-199286 | 8/2007 |
| JP | 2007-322888 | 12/2007 |

* cited by examiner

*Primary Examiner* — David Gray
*Assistant Examiner* — Barnabas Fekete
(74) *Attorney, Agent, or Firm* — Kubotera & Associates, LLC

(57) ABSTRACT

A fixing device fixes a recording medium with a toner image transferred thereon. The fixing device includes an endless belt heated with a heating member; a first pressing member contacting with the endless belt and extending the endless belt together with the heating member; a second pressing member for pressing the endless belt and sandwiching the endless belt together with the first pressing member; and a high thermal conductive member contacting with an inner surface of the endless belt and disposed along a direction crossing a direction that the endless belt moves.

12 Claims, 8 Drawing Sheets

FIXING DEVICE AND IMAGE FORMING APPARATUS

BACKGROUND OF THE INVENTION AND RELATED ART STATEMENT

The present invention relates to a fixing device provided in a copier, a printer, a facsimile, and the likes, and to an image forming apparatus having the fixing device.

A conventional image forming apparatus includes a fixing device using an endless belt for reducing power consumption or shorting a start-up time (refer to Patent Reference). Patent Reference: Japanese Patent Publication No. 2006-154823

FIG. 9 is a schematic view showing a conventional fixing device using an endless belt. As shown in FIG. 9, the conventional fixing device includes a pressing roller 2' formed of a shaft metal 2*a'* and an elastic layer 2*b'*. The pressing roller 2' receives a rotational drive force from a drive source (not shown) through the shaft metal 2*a'*.

Further, the conventional fixing device includes a fixing roller 3' formed of a shaft metal 3*a'* and an elastic layer 3*b'*. The pressing roller 2' presses the fixing roller 3' to form a nip portion N. The conventional fixing device further includes a fixing belt 4' or an endless belt having a cylindrical shape placed between the fixing roller 3' and a supporting member 5', and a heat source 6' having a plate shape disposed in the fixing belt 4'.

In the conventional fixing device described above, the drive source (not shown) drives the pressing roller 2' to rotate. When the pressing roller 2' rotates, the fixing roller 3' follows the pressing roller 2' to rotate through a frictional force between the pressing roller 2' and the fixing belt 4', and a frictional force between the fixing belt 4' and the fixing roller 3'. When the fixing roller 3' rotates, the fixing belt 4' moves against a frictional force between the fixing belt 4' and the supporting member 5'.

In the conventional fixing device described above, the heat source 6' maintains the fixing belt 4' at a specific temperature. To this end, the fixing belt 4' is formed of a material with high heat resistance and a low thermal conductivity. The fixing belt 4' maintained at the specific temperature moves a recording sheet (not shown) to pass through the nip portion N. Accordingly, un-fixed toner is heated and pressed on the recording sheet for fixing. The pressing roller 2' presses the fixing roller 3' to form the nip portion N, so that a sufficient amount of heat is supplied to the recording sheet and un-fixed toner.

In the conventional fixing device described above, when the fixing belt 4' maintained at the specific temperature moves the recording sheet to pass through the nip portion N, the recording sheet (a medium) absorbs heat from the fixing belt 4' at a portion thereof where the recording sheet contacts with (a medium passing portion) corresponding to a width of the recording sheet perpendicular to a direction that the recording sheet is transported. On the other hand, the recording sheet does not absorb heat from the fixing belt 4' at other portion thereof where the recording sheet does not contact with (a medium non-passing portion) corresponding an area outside the width thereof.

Further, when the fixing belt 4' is formed of a material having a low thermal conductivity, a temperature difference is generated between the medium passing portion and the medium non-passing portion. As a result, when the media are transported continuously, the medium non-passing portion is excessively heated, thereby making it necessary to wait until a temperature thereof decreases.

In view of the problems described above, an object of the present invention is to provide a fixing device and an image forming apparatus capable of solving the problems of the conventional fixing device.

Further objects and advantages of the invention will be apparent from the following description of the invention.

SUMMARY OF THE INVENTION

In order to attain the objects described above, according to the present invention, a fixing device fixes a recording medium with a toner image transferred thereon. The fixing device comprises an endless belt heated with a heating member; a first pressing member contacting with the endless belt and extending the endless belt together with the heating member; a second pressing member for pressing the endless belt and sandwiching the endless belt together with the first pressing member; and a high thermal conductive member contacting with an inner surface of the endless belt and disposed along a direction crossing a direction that the endless belt moves.

In fixing device of the present invention, the high thermal conductive member contacts with the inner surface of the endless belt, and is disposed along the direction crossing the direction that the endless belt moves. Accordingly, it is possible to conduct heat from a medium non-passing portion to a medium passing portion of the endless belt, thereby reducing a temperature difference between the medium non-passing portion and the medium passing portion. As a result, even when the recording media are transported continuously, it is possible to prevent the medium non-passing portion from being excessively heated, thereby making it possible to shorten a wait time until a temperature thereof decreases.

DETAILED DESCRIPTION OF PREFERRED EMBODIMENTS

Hereunder, embodiments of the present invention will be explained with reference to the accompanying drawings. In the embodiments, a color printer 1 is explained as an image forming apparatus for forming an image.

Figure 1:
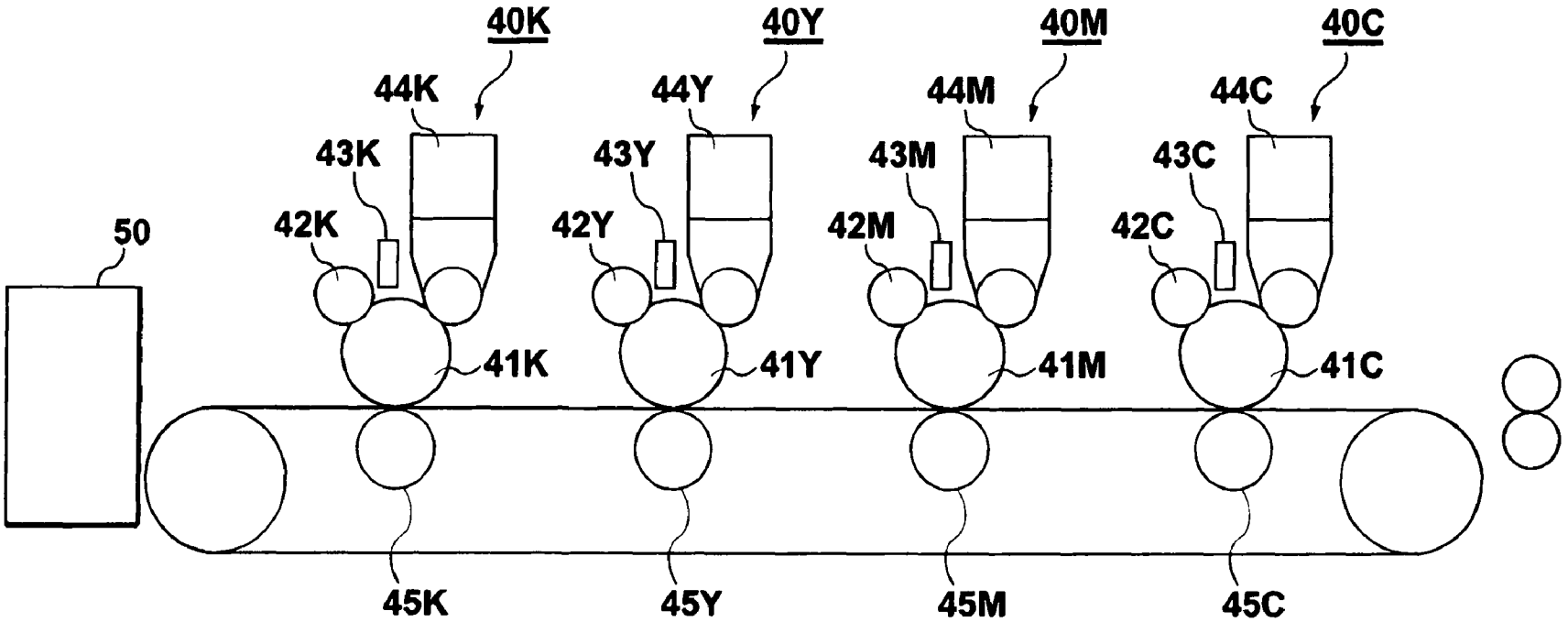
FIG. 1 is a schematic side view showing an image forming apparatus according to the present invention.

FIG. 1 is a schematic side view showing an image forming apparatus according to the present invention. As shown in FIG. 1, the image forming apparatus 1 includes a fixing device 50, and developing devices 40K, 40Y, 40M, and 40C for fixing images in black, yellow, magenta, and cyan.

In the embodiments, the developing devices 40K, 40Y, 40M, and 40C have an identical configuration, and a configuration of the developing device 40K will be explained in more detail as an example.

As shown in FIG. 1, the developing device 40K includes an image supporting member 41K; a charging unit 42K; a latent static image forming unit 43K; a developing unit 44K; and a transfer unit 45K. The image supporting member 41K is formed of a photosensitive drum. The charging unit 42K charges a surface of the image supporting member 41K with a negative polarity. The latent static image forming unit 43K irradiates the surface of the image supporting member 41K charged with the negative polarity, thereby forming a latent static image. The developing unit 44K supplies toner to the latent static image for developing. The transfer unit 45K transfers a toner image thus developed to a recording medium.

After the transfer unit 45K transfers the toner image to the recording medium, the fixing device 50 fixes the toner image on the recording medium, thereby discharging the recording medium. In the embodiments described below, the fixing device 50 will be explained in more detail with reference to the accompanying drawings.

First Embodiment

Figure 2:
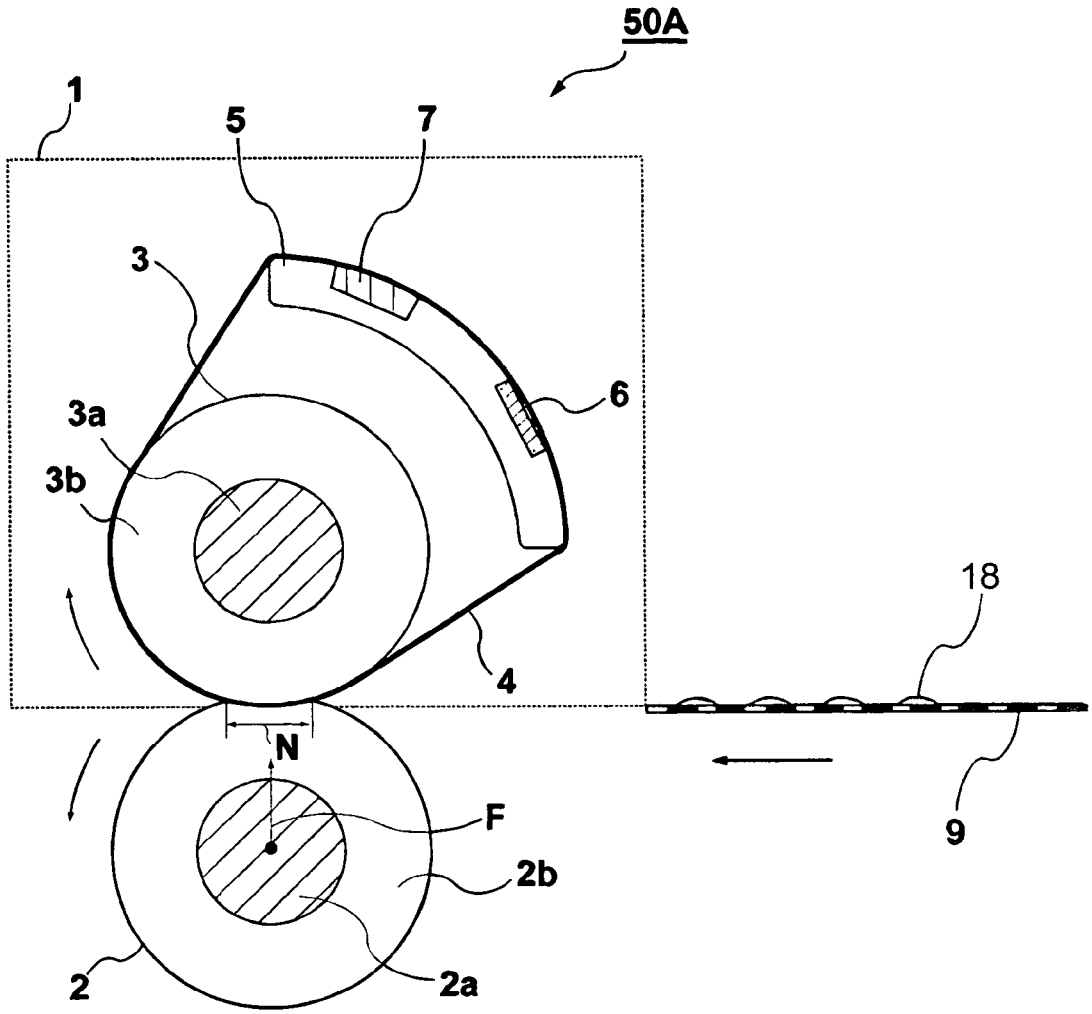
FIG. 2 is a schematic view showing a fixing device according to a first embodiment of the present invention.

A first embodiment of the present invention will be explained. FIG. 2 is a schematic view showing a fixing device 50A according to the first embodiment of the present invention. As shown in FIG. 2, the fixing device 50A includes a pressing roller 2; a fixing roller 3; a fixing belt 4; a supporting member 5; a heating member 6; and a metal plate 7.

In the embodiment, the pressing roller 2 is a roller formed of a metal shaft 2*a* and an elastic layer 2*b*, and presses against the fixing roller 3 with a pressing force F to form a nip portion N. The pressing roller 2 receives a rotational drive force from a drive source (not shown), and has an outer diameter between 20 mm and 40 mm.

In the embodiment, the metal shaft 2*a* is formed of a material such as steel and the likes, receives the rotational drive force from the drive source (not shown), and is supported on a bearing (not shown) to be rotatable. The elastic layer 2*b* is coaxially formed on an outer circumferential surface of the metal shaft 2*a*, is formed of a heat resistant material such as a silicone rubber, and has a thickness between 1 mm and 10 mm. Further, a release layer (not shown) is formed on a surface of the elastic layer 2*b*. The release layer is formed of a material such as a fluorine resin, and has a thickness between 10 μm and 50 μm.

In the embodiment, the fixing roller 3 is a roller formed of a metal shaft 3*a* and an elastic layer 3*b*, and receives the pressing force F from the pressing roller 2 to form the nip portion N. The fixing roller 3 has an outer diameter between 20 mm and 40 mm. The fixing roller 3 receives the rotational drive force from the pressing roller 2 through a frictional force between the pressing roller 2 and the fixing belt 4, and a frictional force between the fixing belt 4 and the fixing roller 3. Accordingly, the fixing roller 3 rotates to drive the fixing belt 4.

In the embodiment, similar to the metal shaft 2*a*, the metal shaft 3*a* is formed of a material such as steel and the likes, and is supported on a bearing (not shown) to be rotatable. The elastic layer 3*b* is coaxially formed on an outer circumferential surface of the metal shaft 3*a*, is formed of a heat resistant material such as a silicone rubber, and has a thickness between 1 mm and 10 mm. Further, a release layer (not shown) is formed on a surface of the elastic layer 3*b*. The release layer is formed of a material such as a fluorine resin, and has a thickness between 10 μm and 50 μm.

Figure 3:
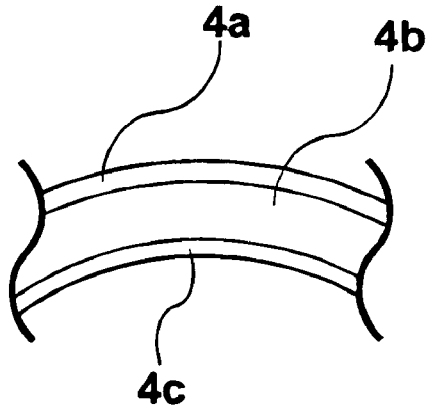
FIG. 3 is a schematic view showing an endless belt of the fixing device according to the first embodiment of the present invention.

In the embodiment, the fixing belt 4 is placed and extended between the fixing roller 3 and the supporting member 5. A configuration of the fixing belt 4 will be explained next in more detail. FIG. 3 is a schematic view showing the endless belt 4 of the fixing device 50A according to the first embodiment of the present invention.

As shown in FIG. 3, the fixing belt 4 or the fixing belt is formed in a cylindrical shape, and is formed of a base member 4*a* and an elastic layer 4*b* formed on an outer circumferential surface of the base member 4*b*. The base member 4*a* is formed of a thin late of a material such as nickel, a polyimide, stainless, and the likes. The elastic layer 4*b* is formed of a material such as a silicone rubber and a fluorine resin.

Further, a release layer 4*c* with a small thickness is formed on a surface of the elastic layer 4*b*. The release layer 4*c* is formed of a material with high heat resistance and a low thermal conductivity such as PFA (perfluoro alkoxy alkane), PTFE (polytetrafluoro ethylene), FEP (perfluoro propene copolymer), and the likes. From a strength and heat resistance points of view, it is preferred that the base member 4*a* has a thickness between 30 μm and 150 μm, the elastic layer 4*b* has a thickness between 50 μm and 300 μm, and the release layer 4*c* has a thickness between 10 μm and 50 μm.

As shown in FIG. 2, the supporting member 5 extends the fixing belt 4 together with the fixing roller 3. The supporting member 5 is formed of a material with high heat resistance such as PPS (polyphenylene sulfide), PEEK (polyether ether ketone), LCP (liquid crystal polymer), and the likes. The supporting member 5 may contain glass fiber, glass bead, and the likes for improving deformation or damage due to heat. Further, the fixing belt 4 or the supporting member 5 may be coated with a fluorine grease for reducing friction.

In the embodiment, the heating member 6 is disposed to abut against an inner surface of the fixing belt 4, and is formed of a plate shape for heating the fixing belt 4. Further, the heating member 6 is disposed at an upstream side of the nip portion N in a direction that the fixing belt 4 moves and in a direction that the recording medium moves as well.

Figure 4:
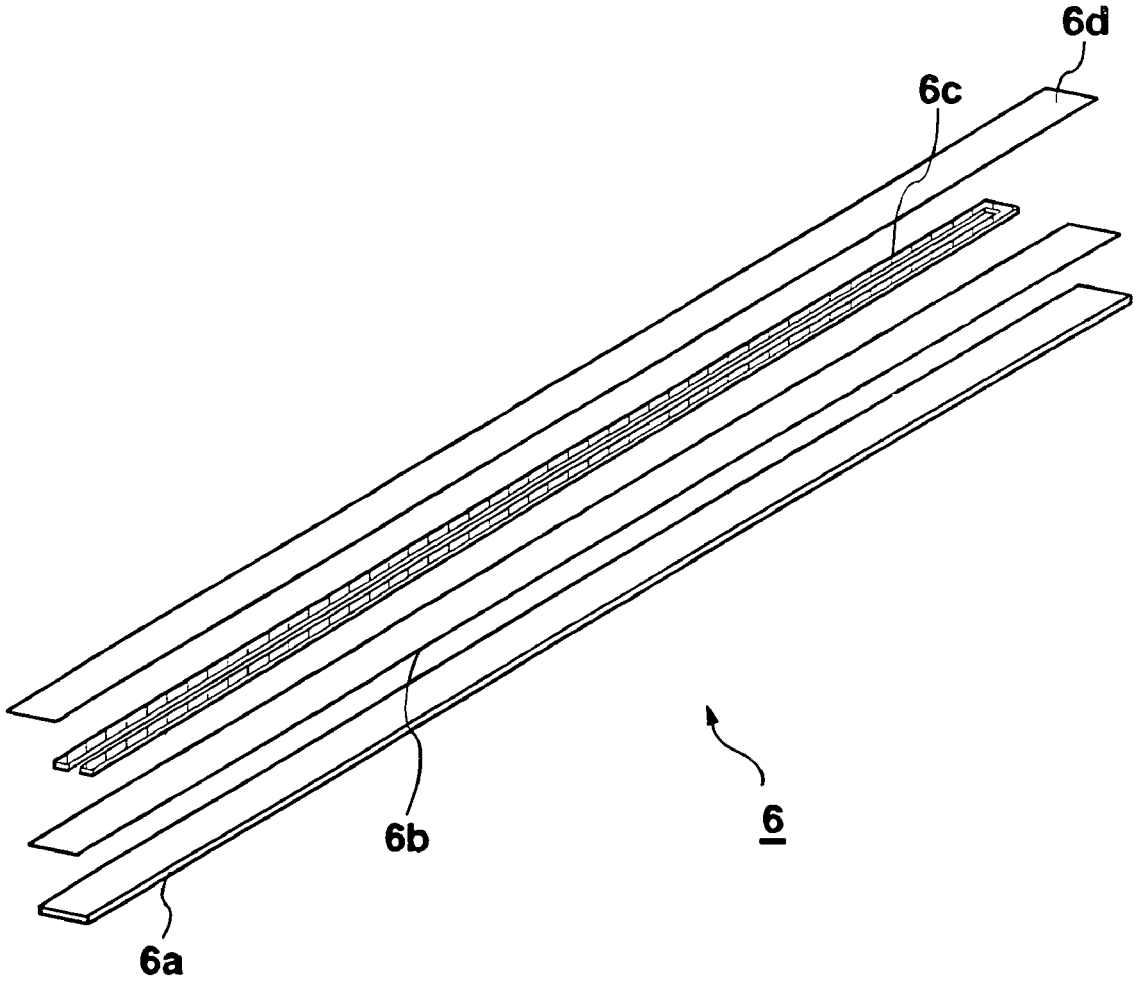
FIG. 4 is a schematic view showing a heating member of the fixing device according to the first embodiment of the present invention.

A configuration of the heating member 6 will be explained next in more detail. FIG. 4 is a schematic view showing the heating member 6 of the fixing device 50A according to the first embodiment of the present invention.

As shown in FIG. 4, the heating member 6 is formed of a base member 6*a*, an electrical insulating layer 6*b*, a resistor heating member 6*c*, and a protective layer 6*d*. The base member 6*a* is a plate formed of a material such as stainless or a ceramic. The electrical insulating layer 6*b* is formed on the base member 6*a*, and is formed of a glass plate and the likes. The resistor heating member 6*c* is formed on the electrical insulating layer 6*b*, and is formed of a material such as a nickel chrome alloy, a silver palladium alloy, and the likes. The protective layer 6*d* protects the resistor heating member 6*c*, and is formed of a material such as glass, a fluorine resin (PFA, PTFE, FEP), and the likes.

Figure 5:
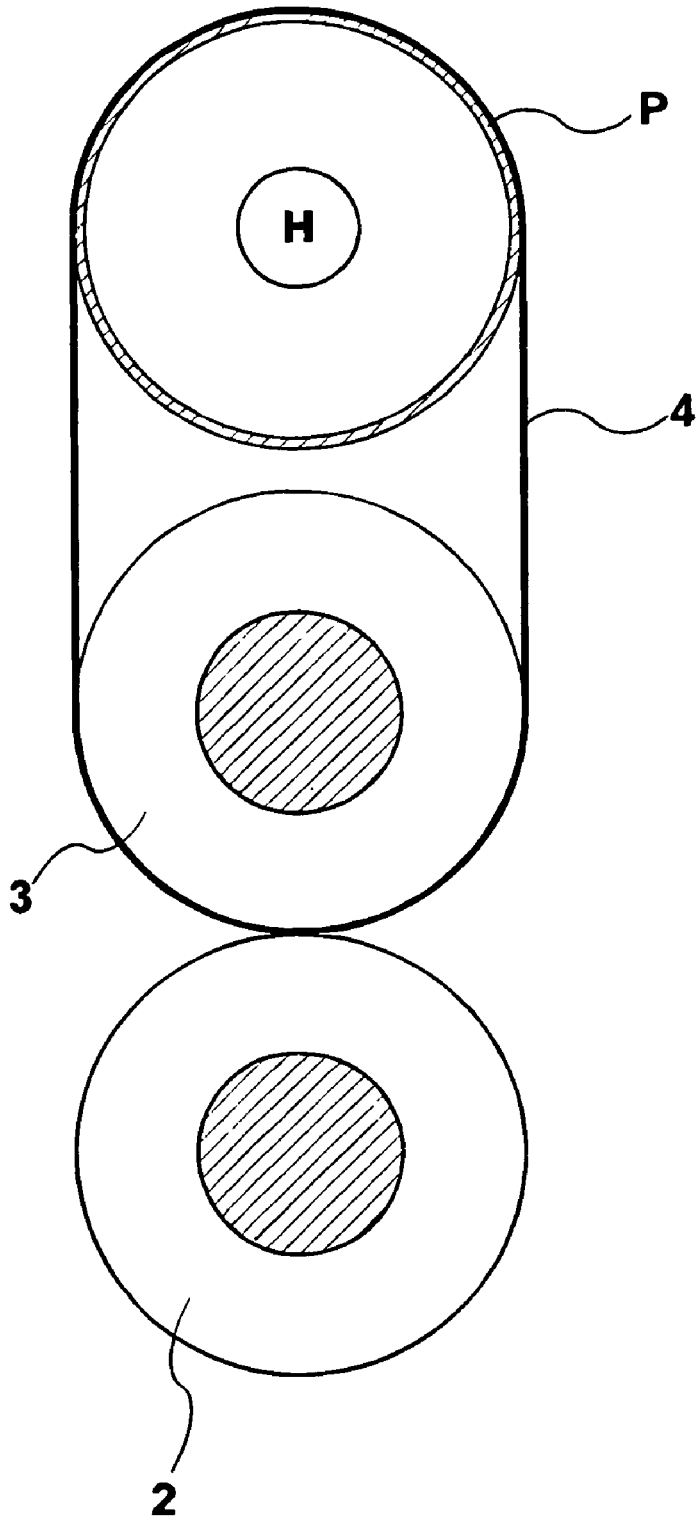
FIG. 5 is a schematic view showing another example of the heating member of the fixing device according to the first embodiment of the present invention.

In the embodiment, the heating member 6 may have another configuration. FIG. 5 is a schematic view showing another example of the heating member 6 of the fixing device 50A according to the first embodiment of the present invention. As shown in FIG. 5, a halogen heater H as a heating source is disposed in a metal pipe P for heating the fixing belt 4 through the metal pipe P.

As shown in FIG. 2, the metal plate 7 is arranged to cross along the direction that the fixing belt 4 moves, so that it is possible to maintain a temperature uniform over a width direction of the fixing belt 4. The metal plate 7 is formed of a material with a high thermal conductivity such as aluminum, and has a section having an area between 30 $mm^2$ and 150 $mm^2$. The material of the metal plate 7 is not limited to a metal, and needs to have a thermal conductivity greater than that of the fixing belt 4.

As shown in FIG. 2, the metal plate 7 is disposed on the supporting member 5 at an upstream side of the nip portion N further than the heating member 6 in the direction that the fixing belt 4 moves, and abuts against the inner surface of the fixing belt 4. Further, the metal plate 7 preferably has a surface with a curvature similar to that of the fixing belt 4 in a state extended between the fixing roller 3 and the supporting member 5, so that the surface of the metal plate 7 smoothly contacts with the inner surface of the fixing belt 4.

Figure 6:
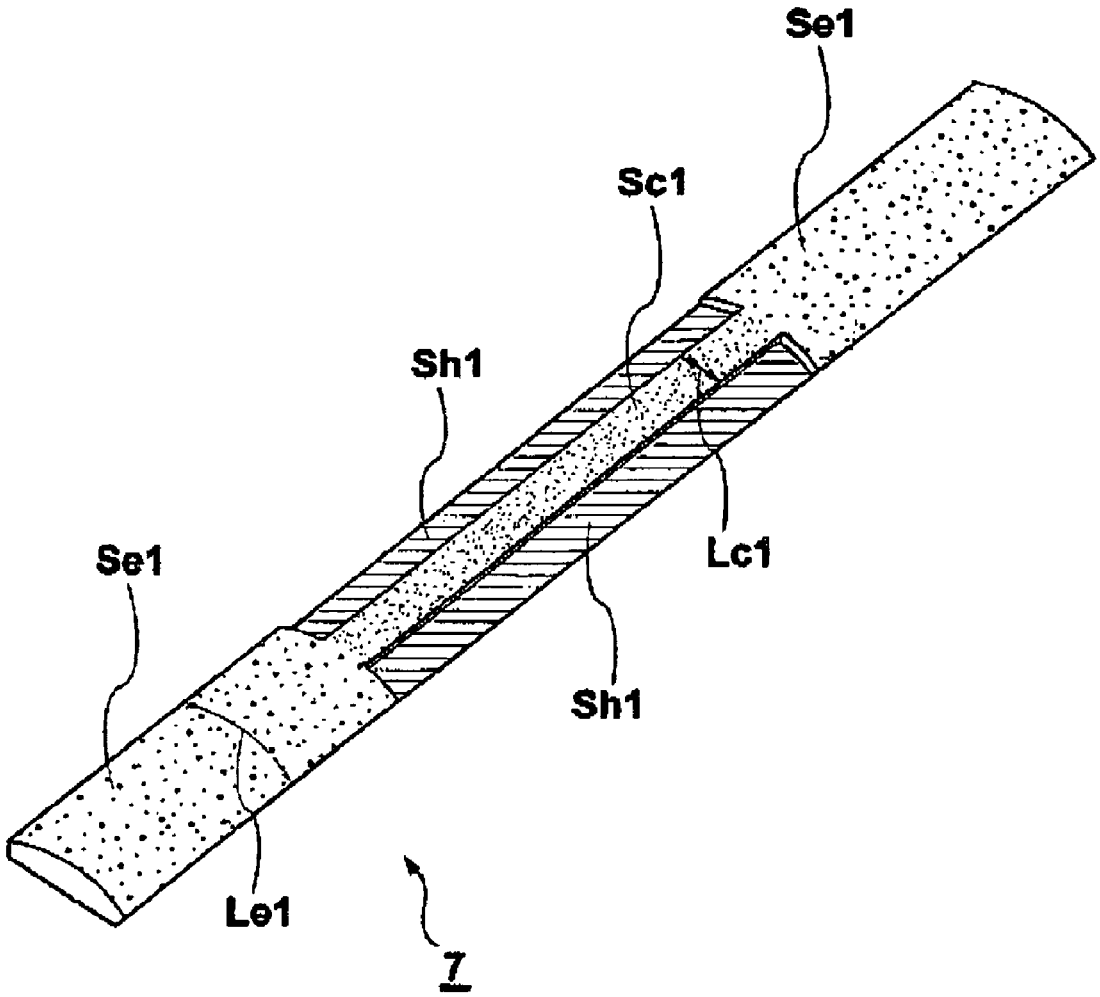
FIG. 6 is a schematic view showing a metal plate of the fixing device according to the first embodiment of the present invention.

A configuration of the metal plate 7 will be explained next in more detail. FIG. 6 is a schematic view showing the metal plate 7 of the fixing device 50A according to the first embodiment of the present invention.

As shown in FIG. 6, the metal plate 7 is configured such that the metal plate 7 contacts with the fixing belt 4 for different lengths or different moving distances according to a position thereof in a longitudinal direction thereof (perpendicular to the direction that the fixing belt 4 moves). More specifically, the metal plate 7 is configured such that both end portions Se1 thereof in the longitudinal direction thereof contact with the fixing belt 4 along an entire length Le1 of the metal plate 7 in the direction that the fixing belt 4 moves. Further, the metal plate 7 is configured such that a center portion thereof in the longitudinal direction thereof contacts with the fixing belt 4 along only a partial length Lc1 of the metal plate 7 in the direction that the fixing belt 4 moves.

In the embodiment, the center portion of the metal plate 7 preferably has a length in the longitudinal direction thereof corresponding to a short side of a medium having the B5 size (confirmed in an experiment).

In the embodiment, the center portion of the metal plate 7 includes a contacting center portion Sc1 where the metal plate 7 contacts with the fixing belt 4 and non-contacting center portions Sh1 where the metal plate 7 does not contact with the fixing belt 4. The contacting center portion Sc1 is arranged to be flash with the both end portions Se1, and step portions are formed between the non-contacting center portions Sh1 and the contacting center portion Sc1.

In the embodiment, a surface of the metal plate 7 is preferably coated with a material with good sliding property and high heat resistance such as PFA (per-fluoro alkoxy alkane), PTFE (poly-tetrafluoro ethylene), FEP (per-fluoro propene co-polymer), and the likes.

An operation of the fixing device 50A will be explained next. As shown in FIG. 2, the pressing roller 2 presses against the fixing roller 3 with the pressing force F to form the nip portion N. When the pressing roller 2 receives the rotational drive force from the drive source (not shown), the fixing roller 3 follows the pressing roller 2 and rotates through the frictional force between the pressing roller 2 and the fixing belt 4, and the frictional force between the fixing belt 4 and the fixing roller 3.

At the same time, the pressing roller 2 drives the fixing belt 4 to move through the frictional force between the pressing roller 2 and the fixing belt 4. When the fixing belt 4 receives the drive force, the fixing belt 4 moves while sliding against the supporting member 5, the heating member 6 and the metal plate 7.

When the heating member 6 is powered on, the heating member 6 is heated and heats the fixing belt 4 through a sliding surface thereof against the fixing belt 4. A temperature detection unit (not shown) detects a surface temperature of the fixing belt 4, and a control unit (not shown) controls power supplied to the heating member 6 according to the surface temperature thus detected. Accordingly, the surface temperature of the fixing belt 4 is maintained at a constant level.

After un-fixed toner 18 is transferred to a recording medium 9, the recording medium 9 is transported through the nip portion N between the fixing belt 4 and the pressing roller 2. At this moment, the pressing roller 2 presses the un-fixed toner 18 and the fixing belt 4 heats the un-fixed toner 18 on the recording medium 9, so that the un-fixed toner 18 is fixed to the recording medium 9. Through an experiment, it is preferred that the fixing roller 3 and the supporting member 5 extend the fixing belt 4 with a force between 0.5 kg and 2.0 kg.

It is assumed that the recording medium 9 is a medium having the B5 size moving in a longitudinal direction thereof. Accordingly, when the recording medium 9 passes through the nip portion N, the medium passing portion of the fixing belt 4 corresponding to the length of the contacting center portion Sc1 of the metal plate 7 (refer to FIG. 6) in the longitudinal direction thereof absorbs heat from the recording medium 9. On the other hand, the medium non-passing portion of the fixing belt 4 corresponding to the length of the both end portions Se1 of the heating member 6 (refer to FIG. 6) in the longitudinal direction thereof does not absorb heat from the recording medium 9.

In the embodiment, the both end portions Se1 of the metal plate 7 slide against the fixing belt 4 over the length Le1 (refer to FIG. 6) in the direction that the fixing belt 4 moves, and the contacting center portion Sc1 of the metal plate 7 slides against the fixing belt 4 over the length Lc1 (refer to FIG. 6) in the direction that the fixing belt 4 moves. Accordingly, the length Le1 is larger than the length Lc1 (Le1>Lc1).

As described above, the elastic layer 4*b* formed on the outer circumferential surface of the base member 4*b* (refer to FIG. 3) is formed of a material such as a silicone rubber and a fluorine resin with a low thermal conductivity. Accordingly, when the recording medium 9 continuously passes through, a surface temperature Te1 of the both end portions Se1 of the metal plate 7 (refer to FIG. 2) becomes higher than a surface temperature Tc1 of the contacting center portion Sc1 of the metal plate 7 (Te1>Tc1). Further, a surface temperature Th1 of the non-contacting center portions Sh1 becomes lower than the surface temperature Tc1 of the contacting center portion Sc1 of the metal plate 7 (Tc1>Th1).

When the state described above is maintained for a specific period of time, since the non-contacting center portions Sh1 do not contact with the fixing belt 4, the surface temperature Th1 of the non-contacting center portions Sh1 gradually becomes higher than the surface temperature Tc1 of the contacting center portion Sc1, and equal to the surface temperature Te1 of the both end portions Se1 (Te1=Th1>Tc1).

When the state described above is maintained for a further longer period of time, since the non-contacting center portions Sh1 and the contacting center portion Sc1 are a same portion of the metal plate 7 in the longitudinal direction thereof with a short thermal conductive distance in between, heat easily conducts from the non-contacting center portions Sh1 to the contacting center portion Sc1. As a result, the temperature of the metal plate 7 is unified along the longitudinal direction thereof, thereby obtaining an advantage as opposed to a case without the non-contacting center portions Sh1.

As described above, in the embodiment, the metal plate 7 is configured such that the metal plate 7 contacts with the fixing belt 4 for different lengths or different moving distances according to a position thereof in the longitudinal direction thereof (perpendicular to the direction that the fixing belt 4 moves). Accordingly, even when media having the B5 size or postcards having a small width are continuously supplied, it is possible to reduce a temperature difference generated according to a position of the fixing belt 4 in the width direction thereof. As a result, it is possible to stabilize properties of the fixing device 50A and extend a lifetime thereof.

Further, in the embodiment, the metal plate 7 is disposed at the upstream side of the heating member 6. Accordingly, it is possible to unify a temperature of the fixing belt 4 at the upstream side of the heating member 6.

In the embodiment, when media having the A3 size or the A4 size having a large width are continuously supplied, the media may absorb heat at a portion of the both end portions Se1. In this case, a temperature difference is generated between the medium passing portion and the end portions of the fixing belt 4. However, it is still possible to obtain a similar effect.

Second Embodiment

A second embodiment of the invention will be described below. Components in the second embodiment similar to those in the first embodiment are designated by the same reference numerals, and explanations thereof are omitted. The components in the second embodiment similar to those in the first embodiment provide effects similar to those in the first embodiment, and explanations thereof are omitted.

In the first embodiment, the supporting member 5 supporting the fixing belt 4 together with the fixing roller 3 (refer to FIG. 2) is formed of a material having a low thermal conductivity. Accordingly, when media having the B5 size or postcards having a small width are continuously supplied, heat tends to accumulate at the medium non-passing portion of the fixing belt 4 (refer to FIG. 2). In the second embodiment, such a shortcoming is solved.

Figure 7:
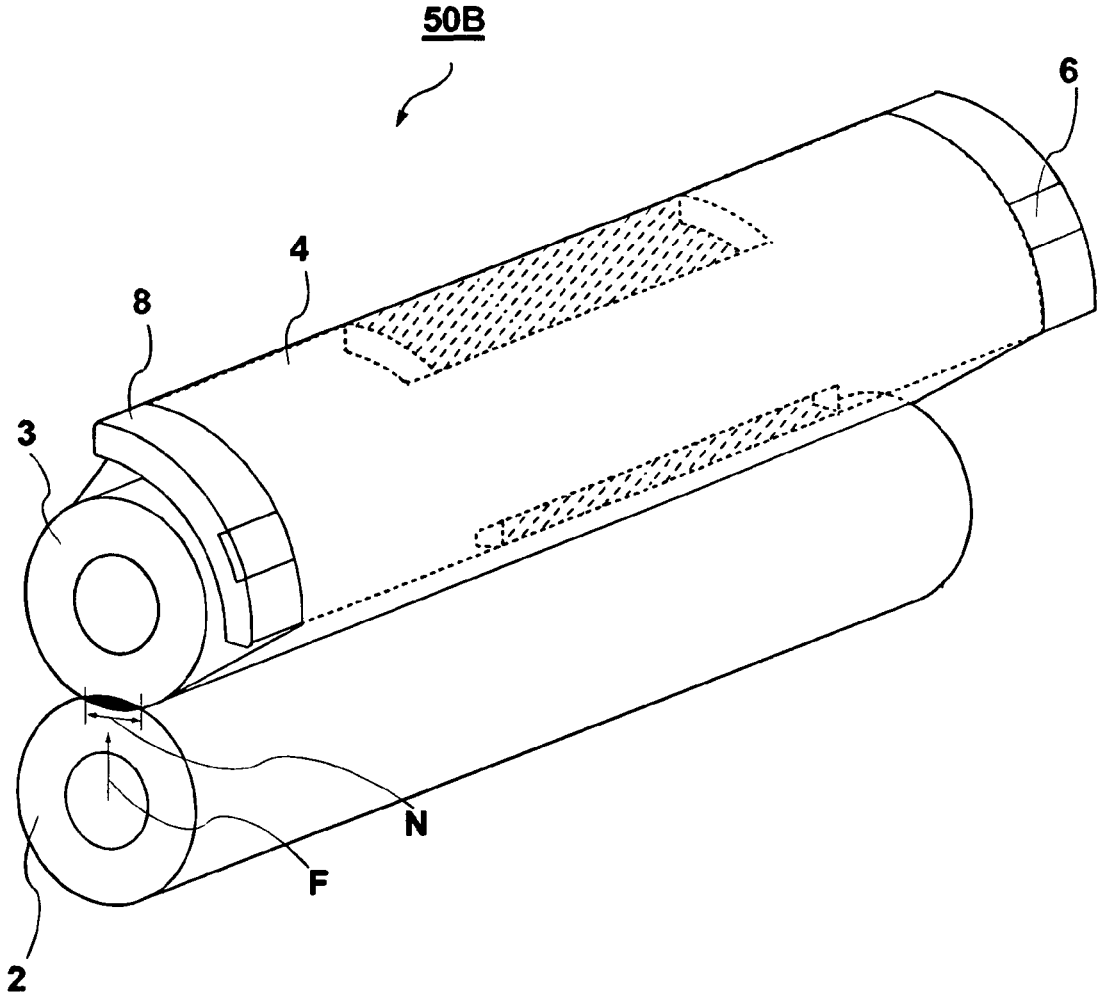
FIG. 7 is a schematic perspective view showing a fixing device according to a second embodiment of the present invention.

FIG. 7 is a schematic perspective view showing a fixing device 50B according to the second embodiment of the present invention. As shown in FIG. 7, the fixing device 50B includes the pressing roller 2; the fixing roller 3; the fixing belt 4; the heating member 6; and a supporting member 8. In the following description, only a difference from the first embodiment will be explained.

In the embodiment, the heating member 6 is embedded in the supporting member 8 to contact with the inner surface of the fixing belt 4. The supporting member 8 has the function of the metal plate 7 in the first embodiment (refer to FIG. 6), and extends the fixing belt 4 together with the fixing roller 3.

Figure 8:
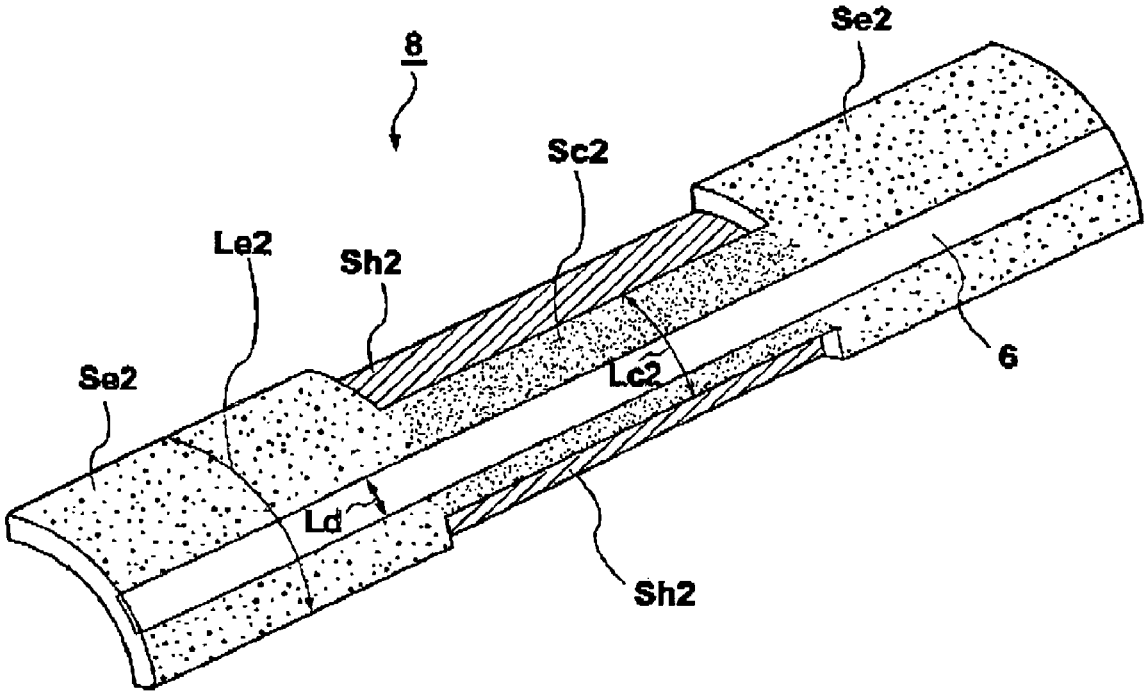
FIG. 8 is a schematic perspective view showing a supporting member of the fixing device according to the second embodiment of the present invention.
Figure 9:
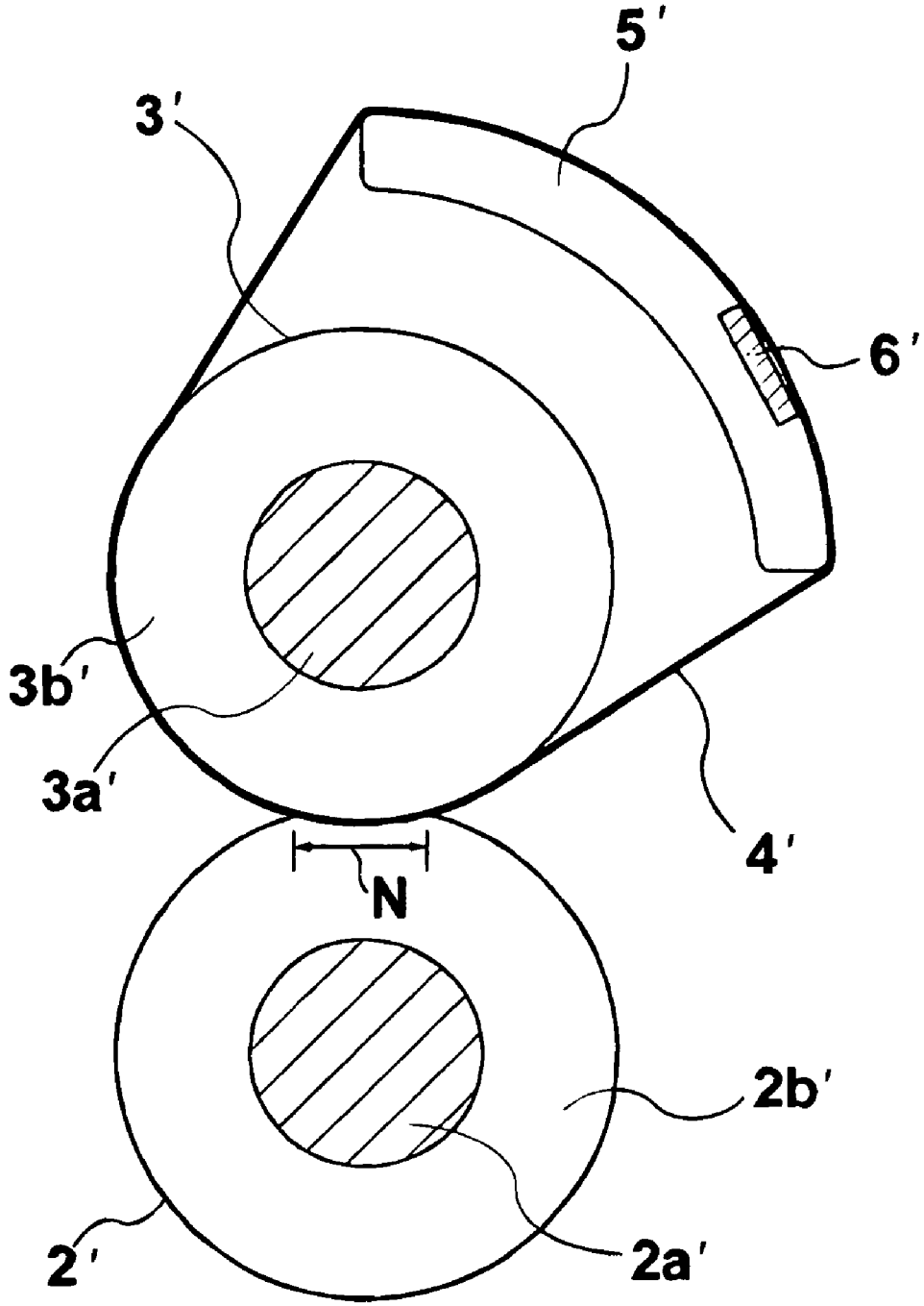
FIG. 9 CONVENTIONAL ART
FIG. 9 is a schematic view showing a conventional fixing device using an endless belt.

A configuration of the supporting member 8 will be explained next in more detail. FIG. 8 is a schematic perspective view showing the supporting member 8 of the fixing device 50B according to the second embodiment of the present invention.

As shown in FIG. 8, the supporting member 8 is formed of a metal plate made of aluminum and the likes. The supporting member 8 is configured such that the supporting member 8 contacts with the fixing belt 4 for different lengths or different moving distances according to a position thereof in a longitudinal direction thereof (perpendicular to the direction that the fixing belt 4 moves). More specifically, the supporting member 8 is configured such that both end portions Se2 thereof in the longitudinal direction thereof contact with the fixing belt 4 along an entire length Le2 of the supporting member 8 including a length Ld of the heating member 6 in the direction that the fixing belt 4 moves.

Further, the supporting member 8 is configured such that a center portion thereof in the longitudinal direction thereof contacts with the fixing belt 4 along only a partial length Lc2 of the supporting member 8 including the length Ld of the heating member 6 in the direction that the fixing belt 4 moves.

In the embodiment, the center portion of the supporting member 8 preferably has a length in the longitudinal direction thereof corresponding to the short side of the medium having the B5 size (confirmed in an experiment).

In the embodiment, the center portion of the supporting member 8 includes a contacting center portion Sc2 where the supporting member 8 contacts with the fixing belt 4 and non-contacting center portions Sh2 where the supporting member 8 does not contact with the fixing belt 4. The contacting center portion Sc2 is arranged to be flash with the both end portions Se2, and step portions are formed between the non-contacting center portions Sh2 and the contacting center portion Sc2.

In the embodiment, the heating member 6 includes the contacting center portion Sc2 of the supporting member 8, and extends into the non-contacting center portions Sh2 of the supporting member 8. Further, the heating member 6 is disposed to contact with the inner surface of the fixing belt 4 at a downstream side of the supporting member 8 in the direction that the fixing belt 4 moves. Accordingly, the supporting member 8 contacts with the fixing belt 4 in a larger area at an upstream side of the heating member 6, thereby making it possible to unify heat at the upstream side of the heating member 6.

In the embodiment, a surface of the supporting member 8 is preferably coated with a material with good sliding property and high heat resistance such as PFA (per-fluoro alkoxy alkane), PTFE (poly-tetrafluoro ethylene), FEP (per-fluoro propene co-polymer), and the likes, thereby improving a sliding property between the supporting member 8 and the fixing belt 4.

An operation of the fixing device 50B will be explained next. As shown in FIG. 7, the pressing roller 2 presses against the fixing roller 3 with the pressing force F to form the nip portion N. When the pressing roller 2 receives the rotational drive force from the drive source (not shown), the fixing roller 3 follows the pressing roller 2 and rotates through the frictional force between the pressing roller 2 and the fixing belt 4, and the frictional force between the fixing belt 4 and the fixing roller 3.

At the same time, the pressing roller 2 drives the fixing belt 4 to move through the frictional force between the pressing roller 2 and the fixing belt 4. When the fixing belt 4 receives the drive force, the fixing belt 4 moves while sliding against the supporting member 8 (including the heating member 6).

When the heating member 6 is powered on, the sliding surface between the heating member 6 and the fixing belt 4 is heated. A temperature detection unit (not shown) detects a surface temperature of the fixing belt 4, and a control unit (not shown) controls power supplied to the heating member 6 according to the surface temperature thus detected. Accordingly, the surface temperature of the fixing belt 4 is maintained at a constant level.

After un-fixed toner is transferred to a recording medium, the recording medium is transported through the nip portion N between the fixing belt 4 and the pressing roller 2. At this moment, the pressing roller 2 presses un-fixed toner and the fixing belt 4 heats un-fixed toner on the recording medium, so that toner is fixed to the recording medium. Through an experiment, it is preferred that the fixing roller 3 and the supporting member 5 extend the fixing belt 4 with a force between 0.5 kg and 2.0 kg.

It is assumed that the recording medium is a medium having the B5 size moving in a longitudinal direction thereof. Accordingly, when the recording medium passes through the nip portion N, the medium passing portion of the fixing belt 4 corresponding to the length of the contacting center portion Sc2 of the supporting member 8 (refer to FIG. 8) in the longitudinal direction thereof absorbs heat from the recording medium. On the other hand, the medium non-passing portion of the fixing belt 4 corresponding to the length of the both end portions Se2 of the supporting member 8 (refer to FIG. 8) in the longitudinal direction thereof does not absorb heat from the recording medium.

In the embodiment, the both end portions Se2 of the supporting member 8 slide against the fixing belt 4 over the length Le2 (refer to FIG. 8) including the length Ld of the heating member 6 in the direction that the fixing belt 4 moves, and the contacting center portion Sc2 of the supporting member 8 slides against the fixing belt 4 over the length Lc2 (refer to FIG. 8) including the length Ld of the heating member 6 in the direction that the fixing belt 4 moves. Accordingly, the length Le2 minus the length Ld is larger than the length Lc2 minus the length Ld (Le2−Ld>Lc2−Ld).

As described above, the elastic layer 4*b* formed on the outer circumferential surface of the base member 4*b* (refer to FIG. 3) is formed of a material such as a silicone rubber and a fluorine resin with a low thermal conductivity. Accordingly, when the recoding media continuously pass through, a surface temperature Te2 of the both end portions Se2 of the supporting member 8 becomes higher than a surface temperature Tc2 of the contacting center portion Sc2 of the supporting member 8 (Te2>Tc2). Further, a surface temperature Th2 of the non-contacting center portions Sh2 becomes lower than the surface temperature Tc2 of the contacting center portion Sc2 of the supporting member 8 (Tc2>Th2).

When the state described above is maintained for a specific period of time, since the non-contacting center portions Sh2 do not contact with the fixing belt 4, the surface temperature Th2 of the non-contacting center portions Sh2 gradually becomes higher than the surface temperature Tc2 of the contacting center portion Sc2, and equal to the surface temperature Te2 of the both end portions Se2 (Te2=Th2>Tc2).

When the state described above is maintained for a further longer period of time, since the non-contacting center portions Sh2 and the contacting center portion Sc2 except the heating member 6 are a same portion of the supporting member 8 in the longitudinal direction thereof with a short thermal conductive distance in between, heat easily conducts from the non-contacting center portions Sh2 to the contacting center portion Sc2. As a result, the temperature of the supporting member 8 is unified along the longitudinal direction thereof, thereby obtaining an advantage as opposed to a case without the non-contacting center portions Sh2.

As described above, in the embodiment, the supporting member 8 is configured such that the supporting member 8 contacts with the fixing belt 4 for different lengths or different moving distances according to a position thereof in the longitudinal direction thereof (perpendicular to the direction that the fixing belt 4 moves). Accordingly, even when media having the B5 size or postcards having a small width are continuously supplied, it is possible to reduce a temperature difference generated according to a position of the fixing belt 4 in the width direction thereof.

Further, the function of the metal plate 7 in the first embodiment is included in the supporting member 8 having a large heat capacity. As a result, it is possible to further stabilize properties of the fixing device 50B.

In the embodiment, when media having the A3 size or the A4 size having a large width are continuously supplied, the media may absorb heat at a portion of the both end portions Se2. In this case, a temperature difference is generated between the medium passing portion and the end portions of the fixing belt 4. However, it is still possible to obtain a similar effect.

In the embodiments described above, the present invention is applied to the color electro-photography printer as the image forming apparatus, and is not limited thereto. The present invention is applicable to an image forming apparatus such as a copier, a facsimile, and the likes. In this case, an image forming unit such as a color electro printer forms a toner image formed of a thermally melt resin, and a fixing device heats and presses the toner image according to image information. The present invention may be applied to the fixing device.

The disclosure of Japanese Patent Application No. 2007-307324, filed on Nov. 28, 2007, is incorporated in the application.

While the invention has been explained with reference to the specific embodiments of the invention, the explanation is illustrative and the invention is limited only by the appended claims.

What is claimed is:

1. A fixing device for fixing a toner image to a recording medium, comprising:

an endless belt moving in a first direction;

a heating member for heating the endless belt;

a first pressing member contacting with the endless belt and extending the endless belt together with the heating member;

a second pressing member for pressing the endless belt and sandwiching the endless belt together with the first pressing member; and a thermal conductive member, contacting with an inner surface of the endless belt and disposed along a second direction crossing the first direction, wherein said thermal conductive member is configured so that a center portion of the thermal conductive member contacts with the endless belt over a distance shorter than that of an end portion of the thermal conductive member along the first direction.

2. The fixing device according to claim 1, wherein said thermal conductive member includes the center portion having a contacting portion contacting with the endless belt and a non-contacting portion not contacting with the endless belt.

3. The fixing device according to claim 1, wherein said heating member is formed in a plate shape.

4. The fixing device according to claim 1, further comprising a supporting member for supporting the heating member, said supporting member and said first pressing member extending the endless belt.

5. The fixing device according to claim 1, wherein said heating member is disposed at an upstream side of the second pressing member in the first direction.

6. The fixing device according to claim 4, wherein said supporting member is adopted to support the thermal conductive member.

7. The fixing device according to claim 1, wherein said thermal conductive member is disposed at an upstream side of the heating member in the first direction.

8. The fixing device according to claim 1, wherein said thermal conductive member is adopted to support the heating member and extend the endless belt.

9. An image forming apparatus comprising the fixing device according to claim 1.

10. The fixing device according to claim 1, wherein said thermal conductive member includes the center portion having a contacting portion contacting with the endless belt at a middle thereof in the first direction, a first non-contacting portion not contacting with the endless belt on an upstream side thereof in the first direction, and a second non-contacting portion not contacting with the endless belt on a downstream side thereof in the first direction.

11. The fixing device according to claim 10, wherein said first non-contacting portion has a length in the first direction greater than that of the second non-contacting portion.

12. The fixing device according to claim 10, wherein said heating member is disposed between the first non-contacting portion and the second non-contacting portion.

* * * * *